US008584381B2

(12) United States Patent
Plake

(10) Patent No.: US 8,584,381 B2
(45) Date of Patent: Nov. 19, 2013

(54) SPORTS FOOTWEAR

(75) Inventor: Glen Plake, Silver Springs, NV (US)

(73) Assignee: Calzaturificio Dal Bello Srl, Casella d'Asolo (TV) (IT)

( * ) Notice: Subject to any disclaimer, the term of this patent is extended or adjusted under 35 U.S.C. 154(b) by 505 days.

(21) Appl. No.: 12/888,817

(22) Filed: Sep. 23, 2010

(65) Prior Publication Data

US 2011/0067266 A1 Mar. 24, 2011

(30) Foreign Application Priority Data

Sep. 23, 2009 (IT) ..... UD2009A0166

(51) Int. Cl.
*A43B 5/00* (2006.01)

(52) U.S. Cl.
USPC ..... 36/117.3

(58) Field of Classification Search
USPC ..... 36/117.3, 25 R, 132, 131
See application file for complete search history.

(56) References Cited

U.S. PATENT DOCUMENTS 3,273,263 A * 9/1966 Klima ..... 36/87
4,351,120 A * 9/1982 Dalebout ..... 36/117.3
4,571,858 A * 2/1986 Faulin ..... 36/117.4
5,474,322 A * 12/1995 Perkins et al. ..... 280/613
5,704,139 A * 1/1998 Okajima ..... 36/115
6,062,586 A * 5/2000 Korman ..... 280/613
7,073,813 B2 * 7/2006 Martin et al. ..... 280/613
2005/0115117 A1 * 6/2005 Morlin ..... 36/117.3
2008/0184597 A1 * 8/2008 Dal Bello et al. ..... 36/97

FOREIGN PATENT DOCUMENTS

JP 02283301 A * 11/1990

OTHER PUBLICATIONS

Italian Search Report issued on May 10, 2010 in Italian Application No. UD20090166.

* cited by examiner

*Primary Examiner* — Marie Patterson
(74) *Attorney, Agent, or Firm* — Panitch Schwarze Belisario & Nadel LLP

(57) ABSTRACT

An article of sports footwear (10) comprises an upper part or casing (11) to partly surround the user's foot, and a sole (12), associated with the casing (11). The sole (12) comprises an internal insole (13) having, during use, an upper surface (13*a*) attached to the casing (11) and a lower surface (13*b*) to which at least an anti-slip support element (14), made of an at least partly soft material, is attached. The insole (13) has a plurality of stiffening elements (15) made of a harder material than that of the anti-slip element (14), and disposed in correspondence with the position of the sole (12) where the front bindings (19) and/or back bindings (20) of the skis act. The stiffening elements (15) are inserted in gaps and spaces present in the anti-slip element (14) so as to be disposed slightly retracted with respect to the at least one anti-slip support element (14) in a non-deformed condition of the latter, as for example when in use for walking, and being able to be disposed at least flush therewith in the deformed condition of the anti-slip element (14), for example when in use for skiing.

4 Claims, 3 Drawing Sheets

SPORTS FOOTWEAR

FIELD OF THE INVENTION

The present invention concerns sports footwear, such as a ski boot, snowboard boot, trekking boot or other.

The present invention is preferentially applied in the field of Alpine skiing, which takes place on mixed slopes in the mountains where the skier uses the skis and also, in intermediate sections where walking is required, also just the boots.

BACKGROUND OF THE INVENTION

Many types of sports footwear, including mountain boots and in particular ski boots or snowboard boots, consist of an upper part or casing, open at the upper part to allow the foot to be inserted, associated with a sole. The sole is normally provided, in its lower part, with notches where water can drain out, and shaped protrusions at the tip and in the heel so the bindings, respectively front and rear, of the ski can be attached.

Solutions are also known where the sole comprises an insole with which an anti-slip support element is associated, made in either one piece or as a number of pieces, and having a thickness adequate to guarantee the right consistency and heat protection to the boot.

An example of how to guarantee the attachment of the anti-slip support element and the insole is described and claimed in the American U.S. Pat. No. 3,273,263.

In any case, the anti-slip support element generally has, on its bottom surface, shapings given by the alternation of ridges and grooves, in order to guarantee that the boot has a good grip on the ground, especially for walking on snow, ice-covered or uneven ground and/or steep slopes, either up or down.

The greater the difference in height between the ridges and grooves, the better the boot grips the ground.

Furthermore, the anti-slip support element is normally made of a rather soft material so as to intensify its grip on the ground.

It is also known that bindings for ski boots are adjusted depending on the overall thickness of the sole. If the sole is subject to deformations or localized compression, as a consequence of stresses of various type applied to it during use, the stability of the ski boot inside the binding is reduced.

One disadvantage of normal ski boots is that, when they are used in combination with skis, the anti-slip support element tends to deform as it is subjected to tension exerted by the ski bindings. Added to this tension there are also the stresses exerted by the skier on the boot, especially going around bends, when the skier's weight is put more on the edges of the skis.

The deformation is a consequence of the softness of the material of which the anti-slip support element is made, and of its shaping, having alternate ridges and grooves.

The deformation of the anti-slip support element causes a reduction in stability of the boot inside the bindings of the ski, with a consequent reduction of safety for the skier.

A further disadvantage linked to the deformation of the anti-slip support element is that this absorbs part of the force exerted by the skier, which otherwise would be discharged onto the binding and consequently on the ski. This reduces the skier's perception of having optimal control of his skis.

In order to reduce these disadvantages, the most used solution is to make a more rigid sole and with a much reduced difference in height between ridges and grooves. This however reduces the grip between the anti-slip support element and the ground, when the boot is used for walking.

Another solution adopted is to adjust the bindings so that they press with greater force on the portions of the sole of the boot with which they are in contact, with the result, however, that it is more difficult to insert such portions of sole into the respective bindings, yet without completely solving the problem when the anti-slip support element is deformed and compressed during skiing.

One purpose of the present invention is to increase the stability of the attachment of the skis and boots, that is to say, to reduce the movement of the boot inside the binding when the boot is used for skiing, at the same time maintaining good gripping capacity of the sole of the boots when these are used for walking.

A further purpose is to reduce the number of accidents due to a perceived instability of the boot inside the binding of the skis, and at the same time to guarantee a safe walk on uneven or snow-covered ground when the boots are used without the skis.

A further purpose of the present invention is to guarantee that the boot enters easily into the binding.

Another purpose is to enable the skier to discharge the weight force applied on the bindings, and therefore on the skis, and to prevent part of said force from being absorbed by the deformation of the sole.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purposes, an article of sports footwear according to the present invention comprises an upper part or casing, which surrounds the user's foot, and a sole associated with the upper part, which can advantageously have, at the front and/or at the rear, shapings for the application of ski bindings.

The sole comprises an insole which, during use, has an upper surface attached to the casing and a lower surface to which at least an anti-slip support element is attached.

The anti-slip support element can be made of one or more pieces, and can cover all the lower surface of the sole, or at least a substantial part of it.

According to a characteristic feature of the present invention, the insole comprises two gripping surfaces on which relative front and back bindings of the ski act. The sole has a plurality of stiffening elements, protruding downward from its lower surface, disposed at least in correspondence with the front and/or the back position of the sole where the ski bindings act, and having at least a contact surface defining a determinate thickness with the relative gripping surface. The thickness corresponds at least to the minimum thickness able to guarantee a correct closing action of the bindings on the boot.

During use, the stiffening elements are slightly retracted with respect to the anti-slip support element in a not particularly stressed condition, so as not to interfere with the characteristics of the sole when the boot is used for walking.

When, on the other hand the boot is used for skiing, the force applied by the bindings to the front and/or back portions of the sole with which they cooperate, together with the weight force applied by the skier on the boot, causes deformation of the sole by compression.

This deformation is such that it causes the stiffening elements to be made flush with the lower surface of the anti-slip support element, so that the bindings act, directly or indirectly, on the stiffening elements, and no longer on the soft anti-slip element, thus guaranteeing the necessary minimum thickness and keeping the stability of the boot on the ski irrespective of the deformations suffered by the anti-slip support element.

According to a variant of the present invention, the insole and the stiffening elements are made in one piece. This allows, when in use, a direct transfer of energy from the boot to the ski with low dispersion of energy. Indeed, the fewer the number of pieces making up the boot and the associated elements, the fewer the dispersions of energy.

According to a further variant of the present invention, the stiffening elements are attached to the lower surface of the insole by means of attachment elements.

According to a further variant of the present invention, the stiffening elements are made of a hard plastic material.

According to a further variant of the present invention, the stiffening elements can be selectively removed from the sole of the boot. In this way the stiffening elements can be replaced if they are worn out, in order to maintain over time optimum and constant performance characteristics of the boot.

BRIEF DESCRIPTION OF THE DRAWINGS

These and other characteristics of the present invention will become apparent from the following description of a preferential form of embodiment, given as a non-restrictive example with reference to the attached drawings wherein.

DETAILED DESCRIPTION OF A PREFERENTIAL FORM OF EMBODIMENT

Figure 1:
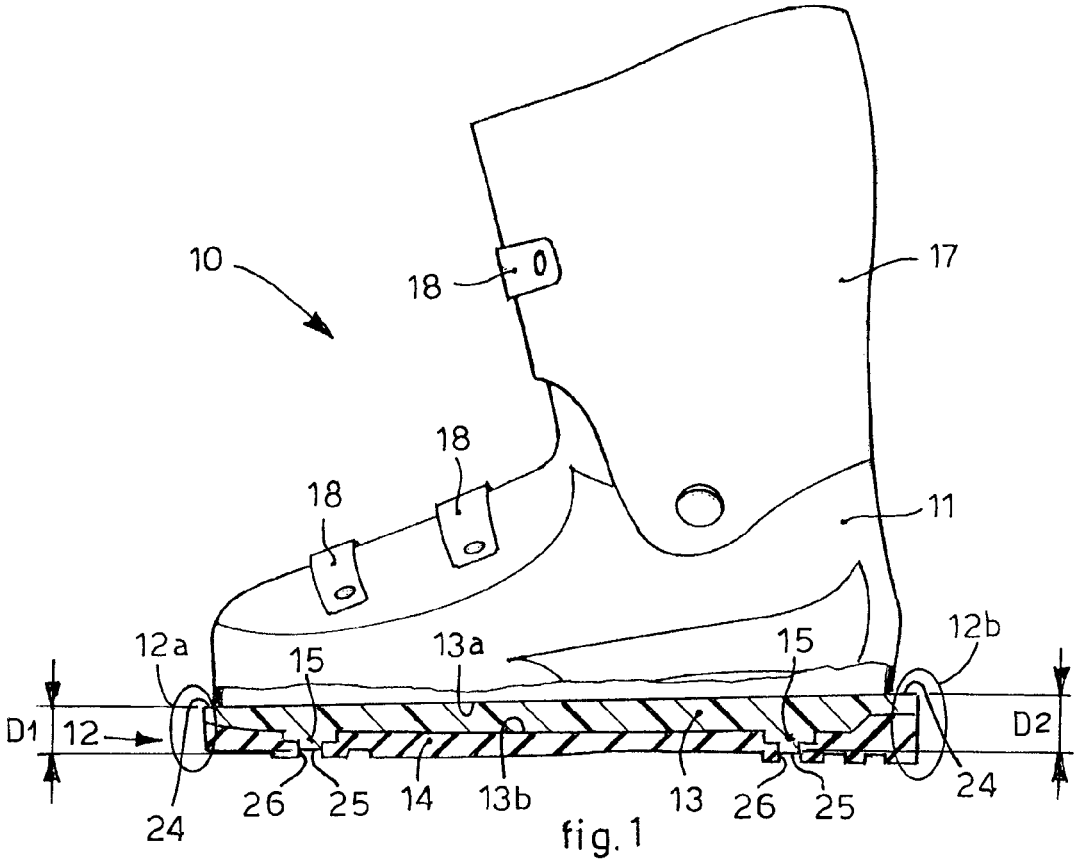
FIG. 1 is a partially sectioned lateral view of a preferential form of embodiment of an article of sports footwear according to the present invention.
Figure 2:
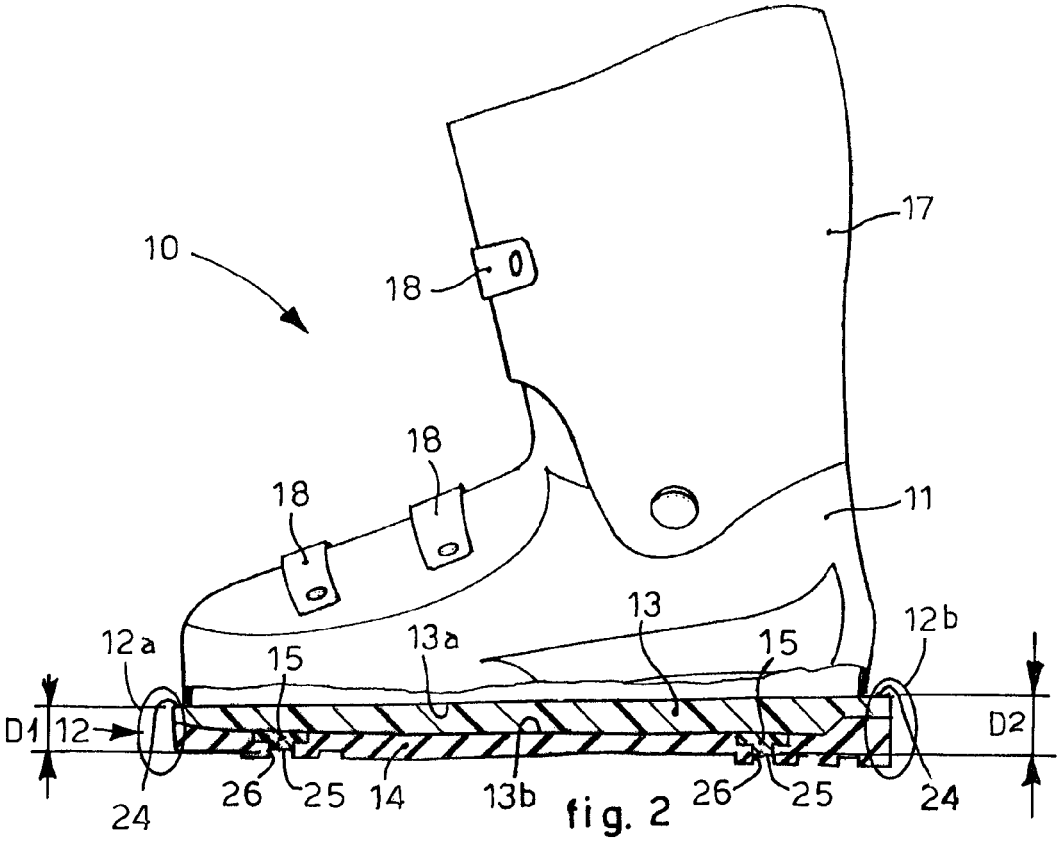
FIG. 2 is a partially sectioned lateral view of another form of embodiment of the sports footwear according to the present invention.

With reference to FIGS. 1 and 2, an article of sports footwear according to the present invention is, in this case, a ski boot 10 consisting substantially of an upper part or casing 11, disposed to cover the user's foot, a protection element 17, hinged on opposite sides to the casing 11, which surrounds the user's tibial zone, and a sole 12 attached below the casing 11.

Operatively the sole 12 contacts the ground, when the boot 10 is used for walking, or the supporting surface of the ski, when the boot 10 is used for skiing.

Closing mechanisms 18 are provided on the casing 11 and/or on the protection element 17, in order to clamp them on the user's foot.

The sole 12 comprises an insole 13, generally made of a hard plastic material, having an upper surface 13*a* in contact with the casing 11 and a lower surface 13*b*, to which an anti-slip support element 14 is attached.

Figure 3:
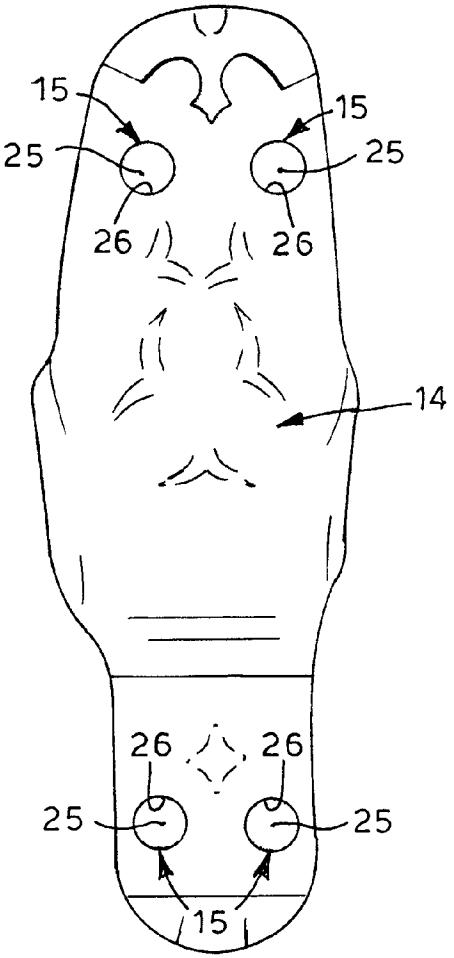
FIG. 3 is a view from below of the sports footwear in FIG. 2.
Figure 5:
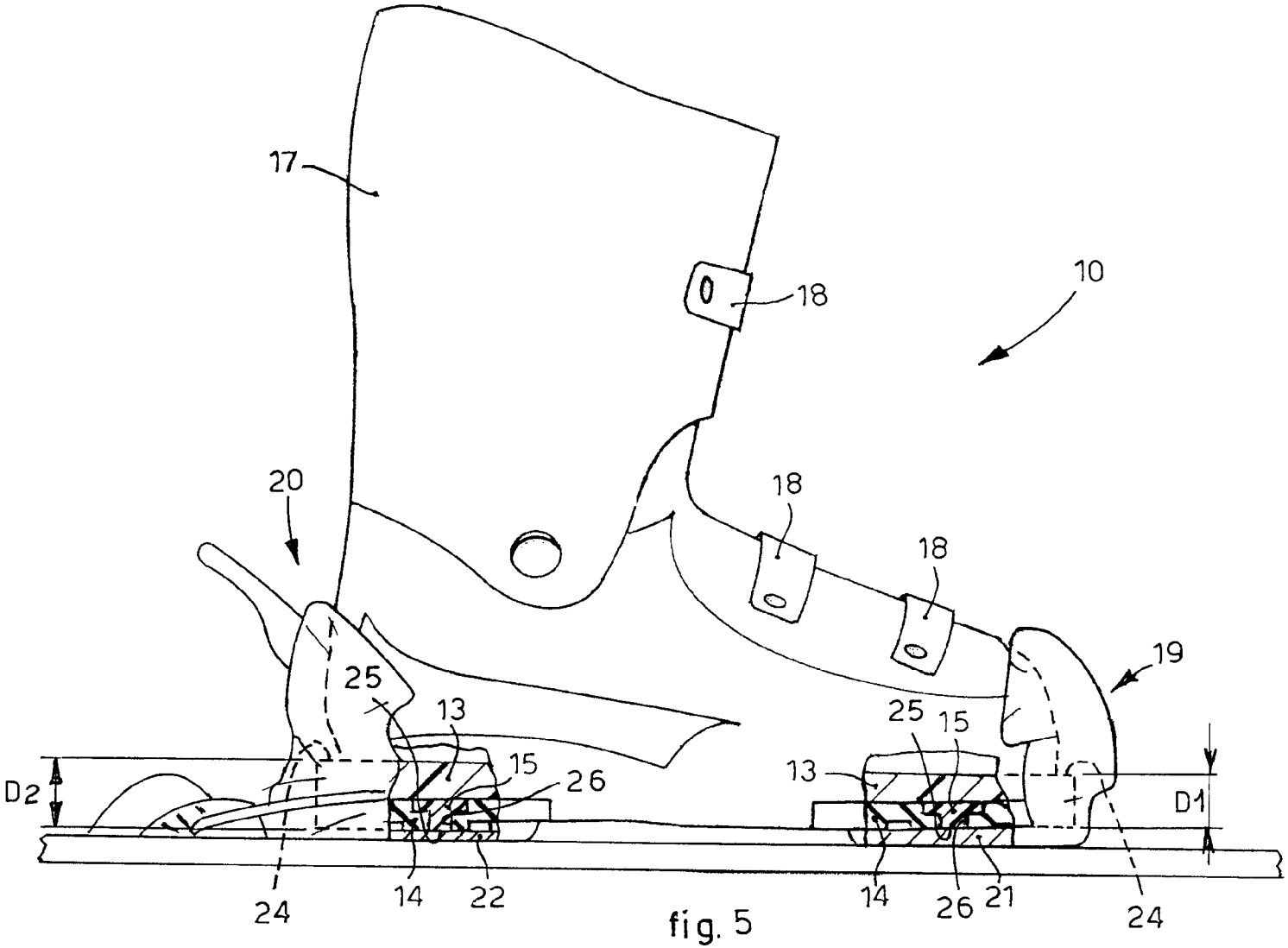
FIG. 5 is a lateral view of the sports footwear mounted on relative ski bindings.

The insole 13 also has projections and shapings 12*a* and 12*b*, protruding respectively from the front and back of the casing 11, suitably shaped to define determinate surfaces 24, for the application of bindings, respectively, front 19 and back 20 of the ski, shown in FIG. 5, to the boot 10. As shown in FIGS. 1, 2 and 3 the anti-slip support element 14 covers substantially all the lower surface 13*b* of the insole 13.

The anti-slip support element 14 is made for example of synthetic or natural rubber, Vibram®, or other material soft enough to get a good grip on the ground, and has a lower surface which is suitably shaped, with alternate spaces and gaps.

Inserted in suitable positions, in this case front and/or back, where the front 19 and back bindings 20 of the skis act, the boot 10 also has stiffening elements 15, made of a rigid material and in any case much harder than that of the anti-slip support element 14. The stiffening elements 15 are disposed in relative openings 26 made through on the anti-slip element 14 and are less able to be deformed by the forces applied on the boot 10 during use while skiing with respect to the anti-slip support element 14.

Each stiffening element 15 comprises a contact surface 25 facing toward the outside of the anti-slip element 14 through the relative opening 26.

Each stiffening element 15 has a height so that its contact surface 25 defines a determinate thickness D1 or D2 with the relative surface 24 of the insole 13.

In this case, the thickness D1 is defined in the zone of the tip or front zone of the boot 10, while the thickness D2, greater than the thickness D1, is defined in the heel zone, or back zone, of the boot 10.

The thickness D1 or D2, being defined between surfaces 24 and 25 made on the elements 15 and 13 made of hard material, remain univocal even in the closed conditions of the bindings 19 and 20 of the ski.

The thickness D1 or D2 correspond to the necessary minimum thickness which there has to be between the components of the bindings 19 and 20, in order to guarantee the correct and safe closing of the latter and, therefore, to maintain the boot 10 in a correct condition of use with respect to the ski.

In the forms of embodiment shown, the stiffening elements 15 are provided both at the front and back of the sole 12, so that when the boot 10 is attached to the ski, they are placed both in correspondence with the front binding 19 and in correspondence with the back binding 20 of the ski (FIG. 5). More precisely, the stiffening elements 15 rest both on a front support base 21 and on a back support base 22 of the bindings, respectively front 19 and back 20.

In this case, the anti-slip element 14 has a thickness such that, when the boot 10 is used for walking, and therefore is in a not particularly stressed condition, the stiffening elements 15 are positioned slightly retracted with respect to the anti-slip element 14 so that the relative contact surfaces 25 remain substantially comprised in the thickness of the anti-slip element 14 and do not interfere with the characteristic features of the sole 12.

Thanks to the degree of elasticity and compressibility of the anti-slip element 14, when the boot 10 is used for skiing the front 19 and the back bindings 20 of the skis, exerting strong stresses on the surfaces 24 of the insole 13, tend to compress the anti-slip element 14 until the contact surfaces 25 of the stiffening elements 15 contact the respective support bases, front 21 and back 22, bringing the boot 10 into direct and rigid cooperation with the skis, thus guaranteeing the stability of the boot 10 in a position of attachment to the ski even when there are strong stresses exerted upon it.

The stiffening elements 15 can be autonomous elements (FIG. 2), they can be possibly removed from the insole 13, in order to replace them when they are worn out or in order to vary as desired the value of the thickness D1 or D2.

With reference to FIG. 1, on the contrary, the two stiffening elements 15 are made in one piece with the insole 13. This allows, during use, a direct transfer of energy from the boot to the ski with low dispersions of energy. In fact, the fewer numbers of pieces making up the boot 10 and the elements associated with it, the fewer the dispersions of energy.

Figure 4:
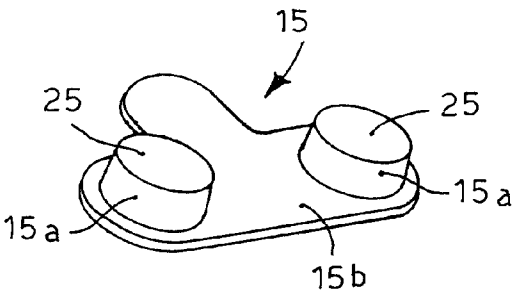
FIG. 4 is an axonometric view of a detail of the sports footwear in FIGS. 2 and 3.

As shown in FIG. 4, each stiffening element 15 has, in this case, a plate 15*b* from which blocks 15*a* or pegs protrude, identical to each other and cylindrical in shape; however, it cannot be excluded that the blocks 15*a* can be made in any solid form and any number of them may be present, in other possible forms of embodiment of the stiffening element 15.

It is clear that modifications and/or additions of parts may be made to the sports footwear 10 as described heretofore, without departing from the field and scope of the present invention.

It is also clear that, although the present invention has been described with reference to some specific examples, a person of skill in the art shall certainly be able to achieve many other equivalent forms of sports footwear, having the characteristics as set forth in the claims and hence all coming within the field of protection defined thereby.

The invention claimed is:

1. Sports footwear for skiing, adapted to be coupled with a front binding and a back binding of a ski, each of the front and back bindings have a support surface, the footwear comprising:

an upper part or casing partly surrounding a user's foot, and a sole, associated with said casing, said sole comprising an internal insole made of a hard plastic material and having an upper surface attached to said casing, and a lower surface to which at least one anti-slip support element, made of a soft and elastic material, is attached, the insole further comprising a front projection and a back projection protruding respectively from the front and the back of the casing, the front and back projections being shaped to define respective surfaces on which the respective front and back bindings of the ski are applied, the insole further comprising a plurality of stiffening elements made of a harder material than that of the anti-slip element, each of the plurality of stiffening elements being disposed in a respective opening extending through the anti-slip element, wherein each stiffening element comprises a contact surface facing toward the outside of the anti-slip element through the respective opening, wherein each opening in the anti-slip element is positioned to correspond with a position of one of the front or back projections where the respective front binding or back binding of the ski are applied, and wherein a height of each stiffening element from the lower surface of the insole corresponds to the minimum thickness needed to guarantee the correct and secure application of said front and back bindings such that when the anti-slip element is in an uncompressed condition, the contact surface of the stiffening element is disposed within the respective opening of the anti-slip element, and when the anti-slip element is in a compressed condition by the application of the front and back bindings, the contact surface of each stiffening element contacts the respective support surface of one of the front and back bindings.

2. Sports footwear as in claim 1, wherein said insole and said stiffening elements are made in a single piece.

3. Sports footwear as in claim 1, wherein the stiffening elements are attached to the lower surface of the insole with attachment elements and can be removed therefrom.

4. Sports footwear as in claim 1, wherein each of the stiffening elements comprises a plurality of blocks.

* * * * *